US006263530B1

(12) United States Patent
Feher

(10) Patent No.: US 6,263,530 B1
(45) **Date of Patent: *Jul. 24, 2001**

(54) SELECTIVELY COOLED OR HEATED CUSHION AND APPARATUS THEREFOR

(76) Inventor: Steve Feher, 1 Keahole Pl., #1505, Honolulu, HI (US) 96825-3414

( * ) Notice: Subject to any disclaimer, the term of this patent is extended or adjusted under 35 U.S.C. 154(b) by 0 days.

This patent is subject to a terminal disclaimer.

(21) Appl. No.: 09/126,914

(22) Filed: Jul. 30, 1998

Related U.S. Application Data

(63) Continuation-in-part of application No. 08/710,959, filed on Sep. 24, 1996, now Pat. No. 6,085,369.

(51) Int. Cl.[7] ..... A47C 27/00

(52) U.S. Cl. ..... 5/423; 5/421; 5/652.2; 168/185

(58) Field of Search ..... 165/185; 5/421, 5/423, 468, 469; 297/180.11–180.14; 62/6, 285; 139/384 R, 387 R, 410; 442/206, 207; 428/72

(56) References Cited

U.S. PATENT DOCUMENTS

| | | | | |
|---|---|---|---|---|
| Re. 24,007 | * | 5/1955 | Foster | 139/384 R |
| 3,009,232 | * | 11/1961 | Martin | 139/384 R |
| 3,137,523 | * | 6/1964 | Karner | 297/180.13 |
| 4,486,493 | * | 12/1984 | Burmester et al. | 5/481 |
| 4,843,826 | * | 7/1989 | Malaker | 62/6 |
| 4,923,248 | * | 5/1990 | Feher | 297/180.13 |
| 4,996,841 | * | 3/1991 | Meijer et al. | 60/525 |
| 5,002,336 | * | 3/1991 | Feher | 297/180.13 |
| 5,117,638 | * | 6/1992 | Feher | 62/3.2 |
| 5,156,005 | * | 10/1992 | Redlich | 62/6 |
| 5,299,867 | * | 4/1994 | Buck | 374/20 |
| 5,331,822 | * | 7/1994 | Billiveau et al. | 62/168 |
| 5,335,639 | * | 8/1994 | Siefkes | 123/545 |
| 5,354,117 | * | 10/1994 | Danielson et al. | 5/421 |
| 5,435,737 | * | 7/1995 | Haga et al. | 439/157 |
| 5,477,687 | * | 12/1995 | Horn | 62/6 |
| 5,477,688 | * | 12/1995 | Ban et al. | 62/6 |
| 5,501,891 | * | 3/1996 | Saika et al. | 139/387 R |

FOREIGN PATENT DOCUMENTS

| | | | | |
|---|---|---|---|---|
| 2694527 | * | 2/1994 | (FR) | 297/180.13 |

* cited by examiner

*Primary Examiner*—Teri Pham Luu

(57) ABSTRACT

A cushion (10, 12) has a plenum (16) which includes a plurality of flexible plastic woven tubes (34) held within a pair of similarly woven sheathes (38,40). The plenum has its sides and bottom covered by an air impermeable (14) layer with the top covered by an air permeable layer (20). A low to medium density foam pad (19) is located between the plenum (16) and the top layer (20). Conditioned air is provided to the cushions (10,12) from a Stirling cycle heat pump (44).

8 Claims, 6 Drawing Sheets

SELECTIVELY COOLED OR HEATED CUSHION AND APPARATUS THEREFOR

This is a continuation-in-part of Ser. No. 08/710,959 filed Sep. 24, 1996, now U.S. Pat. No. 6,085,369.

BACKGROUND

1. Field of the Invention

The present invention relates to a cushion, such as for use as a mattress or seat and backrest, for example, which presents an outer surface of selectively variable temperature and apparatus therefor including a heat pump for reducing cushion temperature operating on a Stirling cycle.

2. Description of Related Art

There are many situations in which it is desirable that a cushion, such as a seat and backrest in an automotive vehicle, for example, be selectively cooled or heated for the comfort of someone sitting or resting against the cushion. In the colder climates, it would be desirable, particularly in the winter time, to obtain relatively instant heating of the seat cushions to warm an individual sitting or leaning on them prior to normal actuation of the auto heating system which typically relies upon the engine coolant being brought up to a sufficiently high temperature for satisfactory operation. In warm seasons, these same vehicles which have conventional air conditioning systems that direct cool air directly on the front of passengers and into the vehicle interior generally, undesirably leave those portions of the individual directly facing and contacting the seat and backrest cushions at an undesirably elevated temperature and, in the case of high humidity, this results in even more discomfort for the vehicle occupant. In both situations, warming or cooling, as the case may be, of the cushions themselves will increase the comfort level of the individual.

Because of believed deleterious effect upon the environment, certain of the more efficient chemical materials (e.g., Freon) are being forced into retirement from use in air conditioning systems. At the present time, all other substitute materials known for this purpose do not possess the same high level of efficiency and are, in truth, substantially inferior in normal operation to those being eliminated. Also, there is the increasing problem that future automotive vehicles may be required to operate on less and less power in order to conserve basic fuels as well as reduce harmful byproducts, and this will, of necessity, leave a lesser proportion of available power for use by air conditioning or heating equipment.

In U.S. Pat. No. 5,002,336, by Steve Feher, there is disclosed a seat and backrest especially constructed for being cooled or heated as desired where the heat pump utilized for this purpose is a thermoelectric unit which accomplishes the desired function with a substantially lower energy requirement than is utilized where the full interior of the vehicle is conditioned in accordance with conventional air conditioning techniques. However, even though considered a substantial improvement over other known and conventional techniques, there is still believed to be room for improvement especially in increasing overall efficiency of operation.

In the '336 patent, the seat and backrest construction includes a plenum for receiving temperature conditioned air, which construction is formed alternatively from either metal wire spring coils or relatively rigid solid plastic tubes with sidewall openings formed therein. To function properly the seat construction must readily allow temperature conditioned air to pass throughout the entire plenum, not close off conditioned air flow to a significant extent from the weight of an individual sitting or leaning on the seating, and at the same time be comfortable.

Still further, automotive seat manufacturer's consider it undesirable that internal supports (e.g., spring coils) should produce a visible surface impression and in that way destroy design esthetics. For example, wire plenum coils and rigid plastic tubes end to "mark" the outermost seat covering (e.g., leather) which is undesirable. Also, it has been found in this regard to be self defeating to merely increase the thickness of a comfort layer located over wire springs or rigid plastic tubes since this reduces heat transference to the extent that overall operational efficiency is reduced.

A persistent problem with wire coils used to form a plenum in a seat such as a vehicle seat is that the coils spread the load weight too evenly giving the sensation of sitting "on top" of the seat rather than in the seat. Accordingly, an individual using the seat may often experience a lack of orthopedic support.

SUMMARY OF THE INVENTION

In describing the present invention in its various aspects, the term "cushion" will refer to a seat, a backrest or mattress-like item that has its temperature conditioned in accordance with and by use of the apparatus described. When either a "seat", "backrest" or "mattress pad" is specifically referred to, those terms will be used.

It is accordingly a primary aim and object of this invention to provide a cushion for variable temperature use which includes an internal plenum for receiving selectively variable temperature air where the plenum is so formed as not to close off during use and yet is comfortable to the touch, does not give external signs of the plenum forming means, and does not require a relatively thick outer comfort layer covering which would create a prohibitive reduction in the level of heat transference.

As a first embodiment of a cushion, filaments of a strong and flexible synthetic resin material are used to form a plurality of loosely woven tubes held between a pair of similarly woven sheaths made from the same material. In this manner, a flexible porous and air permeable pad is provided which will be sufficiently rigid to resist closing off more than about 10% of any of the tubular chambers by someone normally leaning, sitting or lying on them and, in that way, enable conditioned air to pass along the tubular portions and outwardly through the woven walls to condition the full volume of the so-formed plenum within the cushion. Although the tubes are constructed of woven plastic filaments, the filaments are not secured to one another at crossover points, but the filaments are free to slide across one another at these points which results in more comfort to a user.

The cushion pad provided has air impermeable bottom and lateral sides while a loose woven textile top cover provides air permeability. For additional flexibility and comfort, a layer of foam of low to medium density and of open cell variety is inserted between the textile covering and the cushion plenum structure described in the immediately preceding paragraphs. The foam layer must be so constructed as to provide good air and vapor permeability.

A conditioned air inlet duct is affixed to the cushion rear edge and is formed to transmit the air into and along a predetermined number of separate channels into the cushion. Where a pair of cushions (e.g., seat and backrest) are to be provided with conditioned air, the duct provides separate multi-channel air streams to each cushion.

A cushion constructed of the referenced air permeable woven monofilament tubes can be sized to serve as a mattress or pad to be placed over a conventional mattress of similar dimensions or to serve as a mattress per se.

A heat pump preferably including a Stirling cycle conditioner is utilized for selectively reducing the temperature of pressurized air moved along a flexible hose to the cushion inlet duct. In practice, a Stirling cycle conditioner can be shown to be 5–6 times more efficient than a thermoelectric cooling device, and less expensive to manufacture. Also, for a given amount of heat pumped, a Stirling pump is smaller than a corresponding thermoelectric unit and approximately the same in weight per unit heat pumped.

The Stirling heat pump preferably is a sealed free-piston unit including a pair of helical coil springs coaxial with a balancing mass for reducing undesirable vibration. In cooling mode, the heat pump cools an outer surface portion ("cold" spot) over which a cap is secured with a set of radially extending heat exchanging fins and a further set of pin-fins. A conduit with a bonnet fitted over the heat exchanging fins and pin fins includes an internal fan for transferring the conditioned air to the cushion.

A ceramic or resistive positive temperature coefficient (PTC) heater mounted to the heat pump cold spot warms the air during heating mode at which time the Stirling pump is maintained inoperative. The heater pin fins promotes more universally directed heat transference with the ambient air.

Condensate that collects on the cooling conditioner is allowed to follow a gravity path into a receiving trap, and then along a conduit to fall onto a felt pad. An electrical heater evaporates the condensate from the felt into the ambient air.

DESCRIPTION OF PREFERRED EMBODIMENTS

Figure 1:
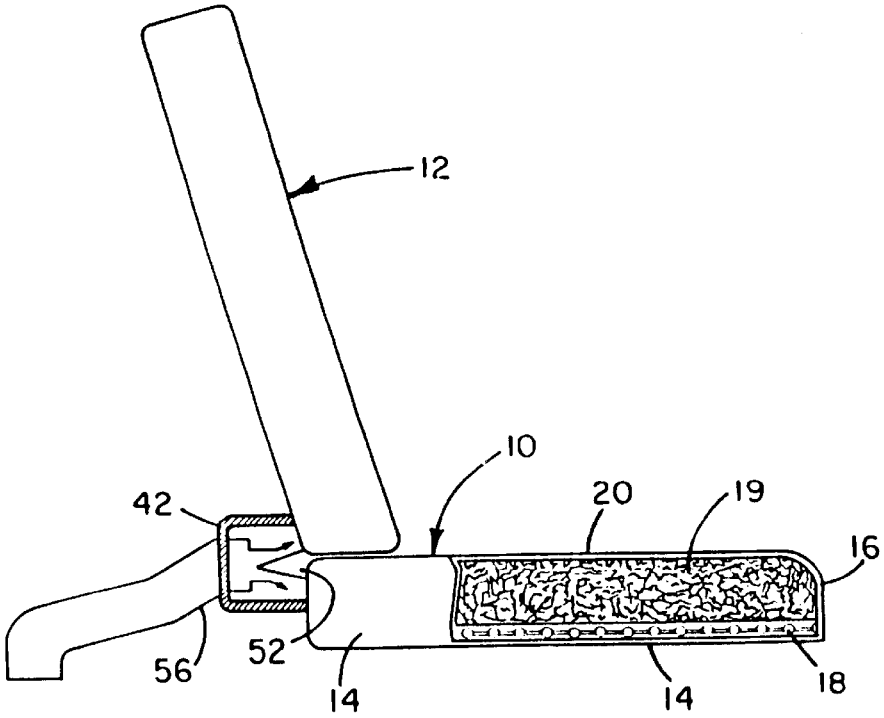
FIG. 1 is a side elevational, partially sectional view of a temperature modifiable seat cushion as described.

Turning now to the drawings and particularly FIG. 1, the invention is shown and described in connection with a pair of cushions 10 and 12 which are manufactured in accordance with the principles of the invention and are particularly adaptable for use in an automotive vehicle where the cushion 10 comprises a seat and the cushion 12 is a backrest. Construction of the two cushions 10 and 12 is identical, therefore, only the construction of cushion 10 will be given in detail.

Figure 2:
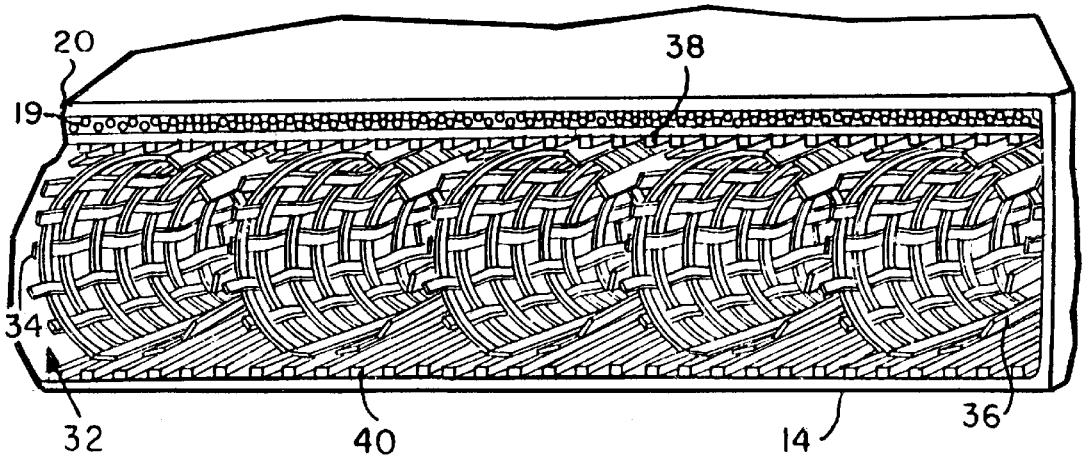
FIG. 2 is an enlarged sectional, partially fragmentary view of the seat cushion.

With additional reference to FIG. 2, cushion 10 is seen to include an outer lower layer 14 covering the cushion bottom, two lateral sides and rear side which can be made of any of a number of different materials with the primary physical characteristic being that it is impermeable to the passage of air and moisture therethrough. An internal portion 16, to be more particularly described later forms a plenum for receiving temperature conditioned air and at the same time providing comfort and possessing necessary rigidity to prevent significant closing off all of any portion of the plenum during use.

Over the top surface of the plenum portion 16 there is located a relatively thin foam layer 19 of low to medium density and open cell construction enabling good air and vapor permeability. The foam layer provides additional comfort to the user. Over the foam layer 19 there is located a woven textile cover or layer 20 which is sufficiently open-weave as to permit air and vapor to pass readily therethrough.

From the cushion construction just described, it is clear that the lateral sides, rear side and bottom of the cushion are impermeable to air while the top and front edge surface facing towards the legs of a user are highly permeable to both air and vapor. Accordingly, in effect, the seat cushion forms a plenum which in a way to be described receives pressurized conditioned air that exits through the permeable portions of the cushion not covered by the body of the user for warming or cooling, as the case may be.

For the ensuing detailed description of cushion construction, reference is made particularly to FIG. 2. As noted, the cushion 10 includes the impermeable layer 14 which covers the bottom surface and lateral sides of the cushion except for the front side. Similarly, there is outermost top textile layer 20, and an underlying foam pad 19. The plenum interior between the foam pad 19 and the impermeable layer 14 is substantially filled with a tubular pad 32 including a plurality of tubular elements 34 extending parallel to each other and generally parallel to the foam pad 19 with the axial directions of each of the tubular elements extending from a rear side surface to the front side surface of the cushion for a purpose to be described. More particularly, the tubular elements are woven from resilient, plastic monofilaments 36 and are arranged in edge contacting relationship forming a generally planar sheet of tubes. The individual tubular elements are unitarily secured together by first and second open-weave layers 38 and 40 which can be constructed of the filaments 36 and are positioned on opposite sides of the tubular element plane and interwoven therewith. In this way, there is a unitary construction in which air can move transversely through the walls of both the tubular elements as well as the open-weave sheets on each side against only modest back pressure, and air flow is restricted by very low back pressure on moving along the axial direction through the tubular elements themselves. In use, the tubular pad 32 just described provides not only a flexible and relatively soft layer upon which an individual can sit or lean against, but also one which will not have its tubular passages closed off during use. Moreover, the woven filament construction does not "mark" the top layer 20 giving an external appearance of the underlying coils.

Figure 11:
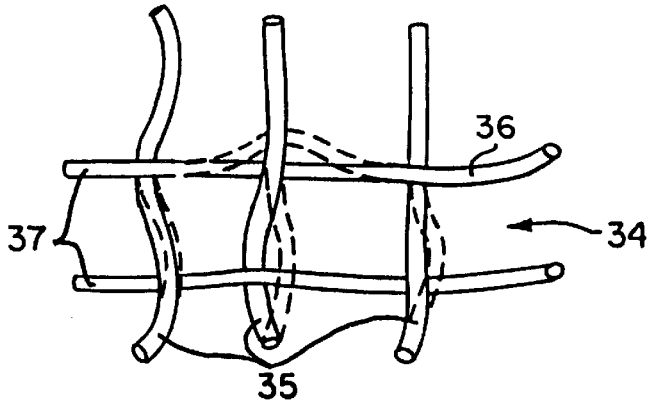
FIG. 11 is an enlarged partially sectional view of plenum forming means of the invention.

As shown schematically in FIG. 11, the tubular elements 34 include filaments 35 that extend lengthwise of the tubes and other filaments 37 that extend crosswise of the tube axes and are interwoven with filaments 35. These filaments are preferably constructed of saran or polyethylene in sizing to be given, but it is believed polypropylene and nylon may also be utilized. Where a seat and backrest are concerned, the tube diameter D can be as small as and preferably about 0.3 inches and constructed of filaments 35 having a diameter of about 0.011 of an inch and filaments 37 having a diameter of bout 0.021 inches. Such a cushion gives enough (not more than 10%) so as to be comfortable giving the feeling of sitting "in" the seat and not on it, while at the same time not marking the uppermost cover, and yet rigid enough not to close off conditioned air supply.

An important aspect of the woven construction of the tubes and interconnected layers 38 and 40 is that the filaments are not sealed to one another at crossover points and can move when submitted to pressure (FIG. 11), which feature provides a certain of softness to the contacting body parts during cushion use. On the other hand, the woven construction and natural physical characteristics of the fibers are such that the tubes do not close off to an objectionable extent during use despite the relative filament movement when experiencing pressure.

The relative thin dimension D of the tubular pad 32 made possible by the use of woven coil tubular elements 34 is especially advantageous when used in an automotive vehicle seat/backrest where there is a predetermined amount of space available. Also, the seat esthetics are important to the vehicle owners and it is not desirable or acceptable to manufacturers to disturb the seat appearance in any significant way. Still further, the present invention can be readily applied to after market seats where minimal space requirements are even more important.

A suitable material from which a tubular pad 32 can be made is manufactured by Tetko, Inc., Briarcliff Manor, New York and sold under the trade designation "Tubular Fabric".

Figure 3:
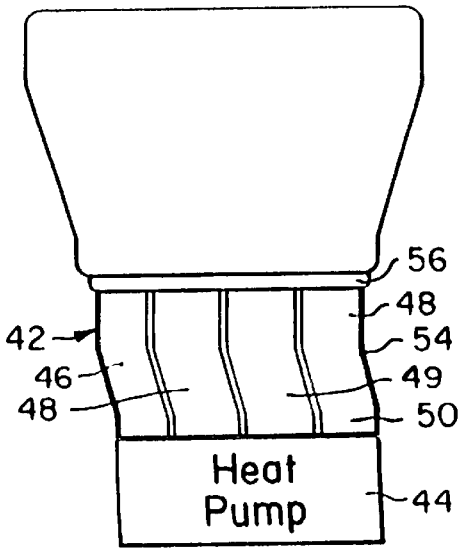
FIG. 3 is an elevational view of a cushion and inlet duct.

FIG. 3 shows an air inlet duct 42 for use in conducting and distributing temperature conditioned air to both a seat and backrest cushions 10 and 12 from a single heat pump 44, the latter to be described in detail later. When viewed in plan, it is seen that the duct is broken into four separate channels 46, 48, 49 and 50 for distribution into both the seat and the backrest at correspondingly different points measured across the width of the respective cushions. In addition, the duct has a separation wall 52 such that the multiple channel delivery for the back rest is separate from the multiple channel delivery to the seat cushion (FIG. 1).

Figure 7:
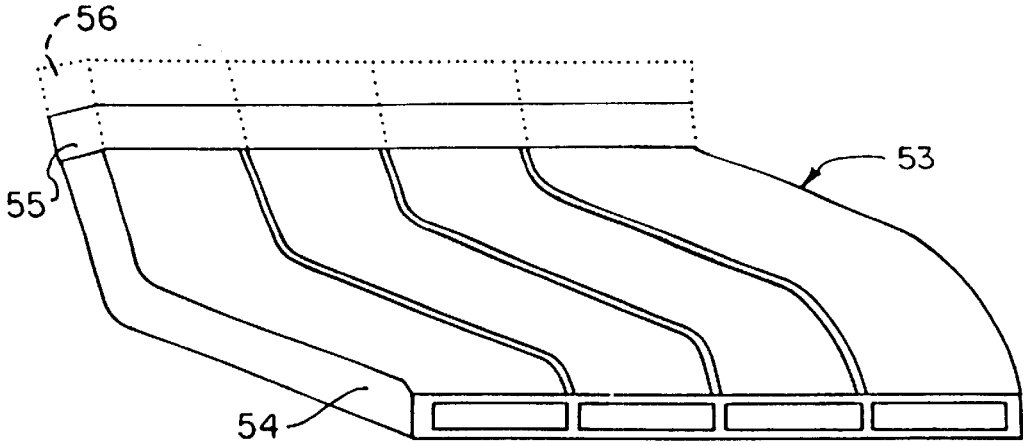
FIG. 7 is a perspective, partially sectional view of a flexible conduit interconnecting with the cushion inlet duct.

More particularly, a flexible multiple channel conduit 53 (FIG. 7) has one end 54 which interconnects with the heat pump 44 for receiving a supply of conditioned air and an opposite end provided with a fitting 55 for releasably connecting with the duct 42. In this way the duct 42 has each of its channels provided with an individual supply of conditioned air.

It is important to note that the conditioned air inlet duct 42 is so arranged with respect to the cushions that an external entrance fitting 56, to which the flexible conduit fitting 55 for conducting conditioned air is connected, is located adjacent a lateral side of the cushion. This enables interconnection to the heat pump via the flexible hose in a manner that does not interfere with positioning of the seat and has been found highly convenient in use. Also, many of the present day automotive vehicles have a strip of cloth sewn into the bightline between the backrest and the seatrest and the asymmetrical positioning of the air inlet duct fitting reduces the possibility of interference on installation in that case.

In general operation of the cushions and associated apparatus described to this point, the conditioned air flow is pressurized from the heat pump 44 along the flexible conduit hose to the air inlet duct 42 where it is separated by the intervening wall 52 into two substantially equal parts for transmission and distribution to the seatrest and backrest cushions. Finally, the conditioned air is broken into four substantially equal portions for each of the cushions and distributed along the cushion to the forward end in the case of the seat, and upwardly in the case of the backrest. In addition to warming or cooling the cushion material surface which faces the user, construction as described permits ready transfer of the conditioned air via convection through the cushion to play in relatively even and very small air streams onto an individual using the cushions.

Figure 4:
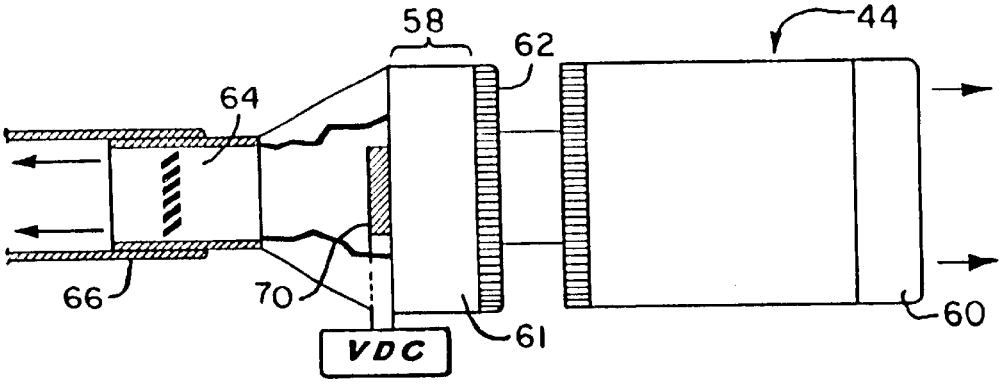
FIG. 4 is an elevational, partially sectional view of a heat pump.
Figure 5:
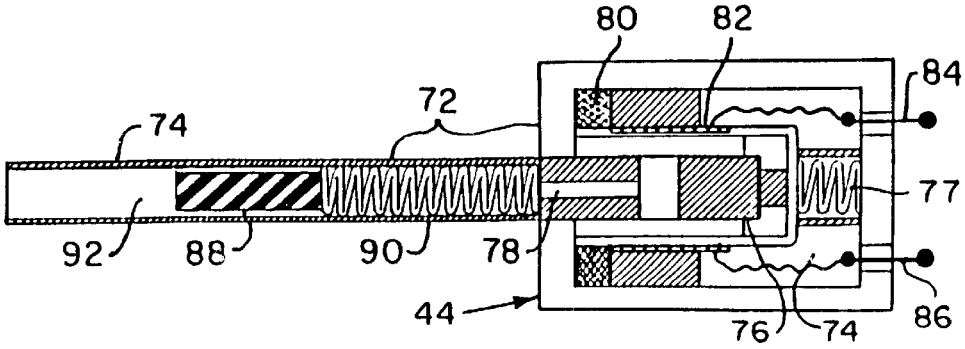
FIG. 5 is a sectional view of a free-piston Stirling cycle device for use in the heat pump of FIG. 4.

Although other heat pumps may be usefully employed for producing conditioned air to the described cushions, the heat pump found most advantageous for present purposes in view of its relatively high At operation and corresponding high efficiency of operation as compared to apparatus relying upon a thermoelectric device (e.g., Peltier), has been a Stirling cycle pump with a free-piston located within a sealed chamber (FIG. 5). In its general aspects, the Stirling cycle heat pump 44 produces a "cold" r end surface 58 while at the same time exiting air containing waste heat at a second or "hot" end 60 (FIG. 4). The cold end 58 of the heat pump is seen to be enclosed by a housing or bonnet 61 also surrounding main heat exchanger fins 62 secured to the outermost surface of the cold end 58 in a good heat conducting relationship (e.g., brazing). A main blower 64 consisting of a fan driven by an electric motor is affixed to the outer end of housing 61 and pulls air away from the heat exchanger fins 62 which have been cooled by the heat pump and pressurizes the cold air for delivery via the flexible hose 66 to the cushions. At this same time, an auxiliary fan (not shown) is located within a further housing in surrounding relationship to the "hot end" 60 of the heat pump. The purpose of the auxiliary fan is to remove waste heat that accumulates at the hot end and direct it externally of the heat pump (arrows, FIG. 4).

Although use of the heat pump has been described in the cooling mode, it is also desirable that means be provided for heating the air during cold or inclement days. For this purpose, heat from the Stirling engine hot end could be channeled to the cushions instead of the cooler air, however, this is not fully satisfactory in that the apparatus would be of necessity be prohibitively bulky and expensive. Instead of using the Stirling cycle pump in a heating mode, it has been found preferable that a ceramic or resistive heater 70 of the positive temperature coefficient category be located on the cold end 58 of the heat pump internally of the heat exchanger housing 61. For use in the heating mode, a sufficient amount of electric current (e.g., 100–150 watts) is passed through the heater 70 to raise the air stream temperature into the cushions to approximately 110° F. during which time the operation of the Stirling heat pump is suspended. Accordingly, the main blower 64 then receiving heat from the heater 70 passes the heated air along the flexible hose 66 into the cushions along the same path as when used in the cooling mode. The heat pump 44 and heater 70 are provided with electrical power along mutually exclusive circuits so that when either one is operating the other is off.

Although other heat pumps operating on the Stirling cycle principle may be found useful, applicant in a practical construction of the invention has achieved superior results with a free-piston, linear, electric motor driven heat pump identified by the trade designation model M223, made and marketed by Sunpower, Inc., Athens, Ohio. Where the air temperature being added to a cushion is approximately 40° F. below ambient, 2.5 watts of refrigeration are obtained for every watt of input to the Stirling pump. Since Stirling cycle pumps have in the past been almost exclusively for refrigeration purposes, and in fact have not been considered suitable for air conditioning applications, the pumps are provided with a relatively small "cold" surface it being contemplated that in use the item to be cooled will be in direct contact with the cold surface. For this reason, modification of a Stirling cycle heat pump in the way to be described is necessary for effecting air conditioning in the present invention.

FIG. 5 shows in sectional view the major parts of a Stirling device 44 useful in practicing the present invention. The device includes a housing 72 enclosing a hermetically sealed chamber 74 filled with gas within which all of the moving parts are located. A free piston 76 is resiliently mounted to the housing by spring 77 for movement toward and away from an internal orifice 78. A magnet 80 and coil 82 surround the piston for driving the same on electric energization via leads 84 and 86. On the opposite side of the orifice 76 there is provided a displacer 88 resiliently mounted by a spring 90 for restricted gas pressure induced movement toward and away from the orifice 78.

During use, the coil 82 is electrically pulsed to produce reciprocal movement of the piston 76 which, in turn, moves pressurized gas through the orifice 78 to drive the displacer into the expansion space 92. Between driving pulses the piston is returned by spring 77 and the displacer is similarly returned by spring 90. By the described reciprocal action, the housing end adjacent the expansion space 92 experiences a temperature reduction whereas the opposite housing end has its temperature increased.

Figure 6:
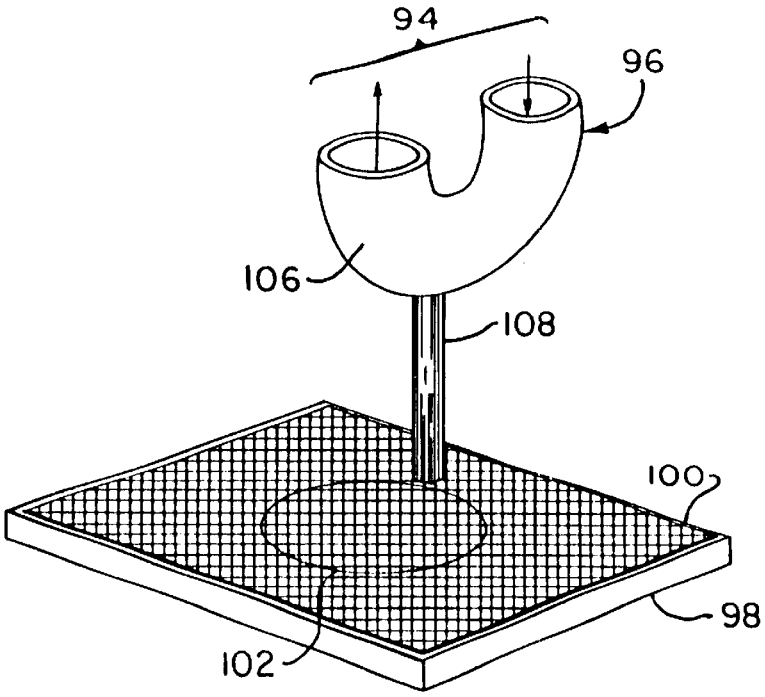
FIG. 6 is a schematic view of condensation elimination means for use with the heat pump of FIG. 4.
Figure 9:
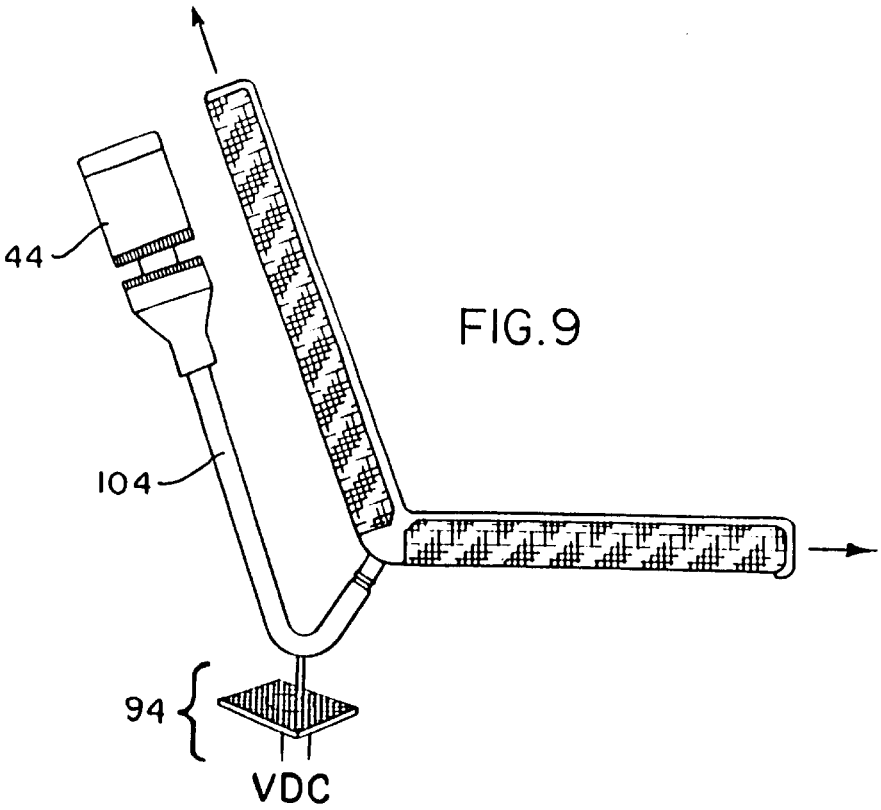
FIG. 9 is a side elevational view of the invention shown with the condensation handling means of FIG. 6.

A continuing troublesome matter has been the elimination of condensate that collects in the heat exchanger fins 62 area in the main heat exchanger during operation in the cooling mode. Most car manufacturers appear to be of the opinion that it is not feasible or desirable to try to remove condensate by draining the excess condensation through the vehicle floor since the drain opening could become clogged or obstructed resulting in undesirable concentrate accumulation on the vehicle floor. To solve this problem in the present invention, there is provided a condensation elimination means 94 (FIGS. 6 and 9) having a condensate trap 96 which includes an aluminum plate 98 onto a major surface of which a felt pad 100 is secured. A ceramic or resistive heater 102 (preferably of the positive temperature coefficient variety which reduces the possibility of overheating) is located on the upper surface of the aluminum plate and interconnected with a suitable electric power source (not shown). A conduit 104 connected to the heat pump and leading to the seat cushion and backrest, for example, has a loop 106 located substantially under the main exchanger heat fins so as to receive condensate dropping thereon along a gravity path. A drain means 108 (alternatively, a felt wick) interconnected with the interior of the loop or trap also feeds along a gravity path to empty the condensate directly onto the felt pad 100. In operation, condensate obtained by the trap and fed along the drain means to moisten the felt pad is then evaporated by the heater 102 so as to return the condensate to the ambient air and eventually to the air external to the vehicle.

Figure 8:
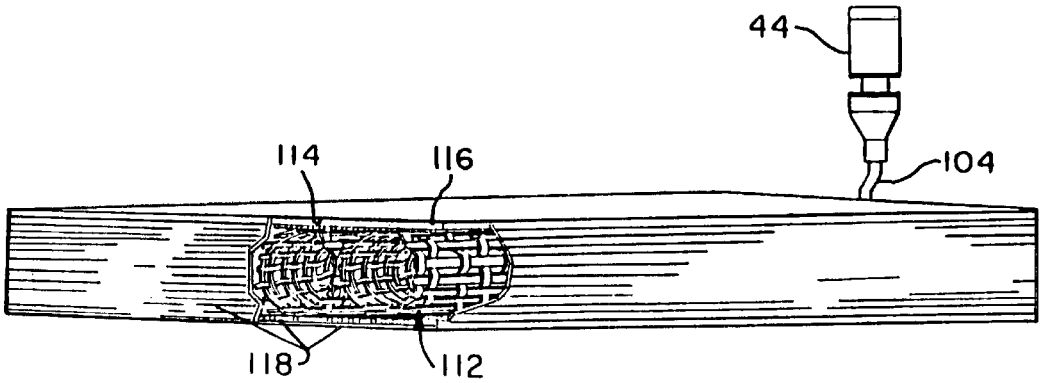
FIG. 8 shows an isometric partially sectional view of an alternative version of cushion for use as a sleeping pad.

With reference now to FIG. 8, there is shown a cushion 110 of overall size sufficient that one or more individuals may lie on it. Specifically, the cushion 110 is constructed identically to the prior described cushion construction shown in detail in FIG. 2 in having a tubular pad 112, an overlying foam pad 114 with permeable upper layer 116, and impermeable outer layer sides and bottom 118. Optionally, the foam pad 114 may be eliminated entirely.

In view of the fact that the width and length dimensions of a pad 112 are considerably greater than those of a seat or backrest pad 32, it has been found necessary to increase the diameter of the woven tubes to preferably about 0.6 inches when using a 0.011 inch fiber for monofilaments 35 and 37 providing a maximum compression of not more than 20°.

Figure 10:
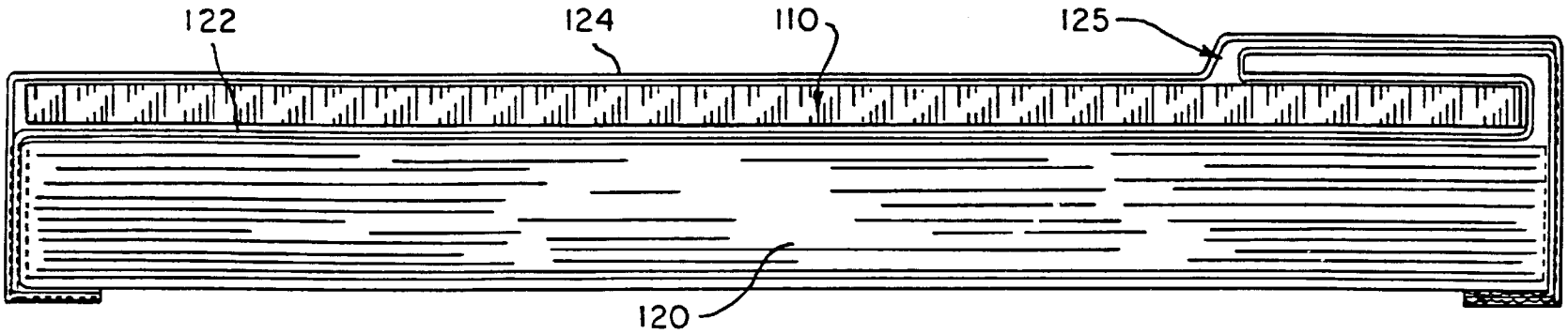
FIG. 10 is a side elevational sectional view of the cushion of FIG. 8 shown assembled to a mattress.

The cushion 110 may be used as a separate and individual mattress or preferably as a pad that is placed on a conventional mattress 120 as shown in FIG. 10. More particularly, in this embodiment the cushion 110 is centrally located on a textile covering 122 such as a fitted sheet, for example, and fixedly secured in this position by layer 124 which is sewn or otherwise affixed to the covering 122. In the region of the cushion which would be opposite the feet of someone lying on it, the cushion is enclosed by a further layer 125 of material which would reduce the cooling effect in that area. The cushion assembly is secured onto the mattress by use of an elastic band, sewing or other conventional securing means. Such a cushion is believed to be especially advantageous for medical use with bedridden patients. Conditioned air is provided to cushion 110 from a Stirling heat pump (not shown) via a suitable conduit in the same manner as in the previously described embodiments (FIG. 8).

Figure 12:
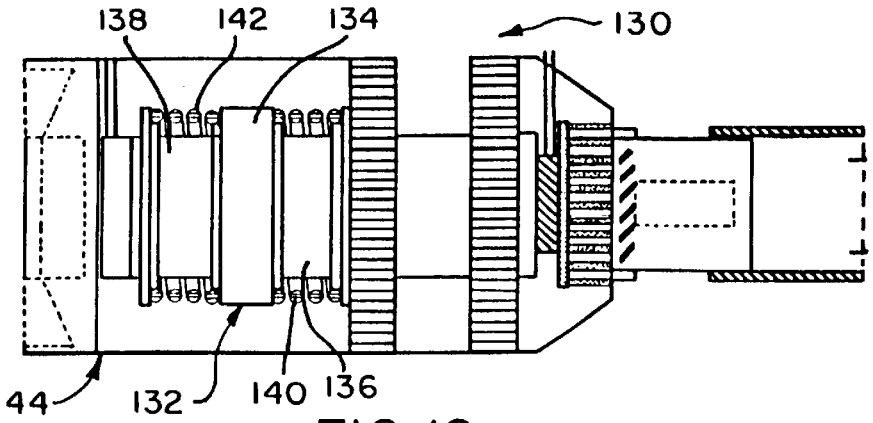
FIG. 12 is a sectional view of an alternative form of Stirling heat pump for use with the invention.

In FIG. 12, there is shown in sectional view an alternative version of Stirling cycle heat pump 130 having a vibration and noise retarding means 132. In normal operation a Stirling cycle heat pump including a free-acting piston is accompanied by a certain amount of vibration and noise which desirably is kept to a minimum where, as in the present invention, the heat pump is to be located within an automotive vehicle closely adjacent say, the front seat or in a bedroom. More particularly, a cylindrical mass 134 having first and second axial extensions 136 and 138, respectively, held within first and second helical springs 140 and 142 is mounted within the heat pump outer housing 44, such that the extensions 136 and 138 are coaxial with the heat pump piston (not shown) path of movement. In operation, vibratory movement and noise induced by operation of the pump piston is damped by counter inertial action of the mass 134.

Figure 13:
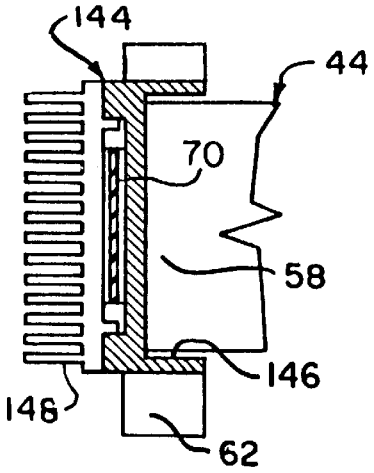
FIGS. 13 and 14 depict a heat transfer connector and alternative form of heating apparatus.
Figure 14:
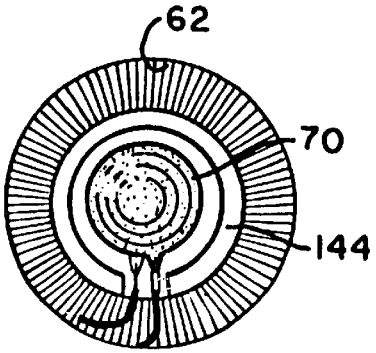

FIGS. 13 and 14 show a heat transferring connector 144 which includes a concavity 146 for fitting receipt onto the cold end surface of heat pump 44. The radially extending main heat exchanger fins 62 are either integral with connector 144 or connected thereto in a good heat conducting relationship. Also, a further set of pinlike fins 148 extend away from the outer surface of connector 144 and serve to act as a further heat exchanger which has been found to be especially advantageous in improving efficiency of operation during heating by the PTC ceramic/resistor 70 affixed to the connector outer surface. The pinlike shape is believed superior to normal flat fin shapes of conventional heat exchangers in more efficiently accommodating pressurized air moving therepast.

Although the present invention has been described in connection with preferred embodiments, it is understood that those skilled in the appertaining arts may make modifications that come within the spirit of the invention disclosed and within the ambit of the appended claims.

What is claimed is:

1. Cushion apparatus for receiving pressurized temperature modified air therein, comprising:

a unitary pad having top, bottom and sides constructed of a plurality of tubular elements sufficiently rigid not to close off more than about 20% when subjected to normal sitting, leaning or lying forces arranged in side-by-side generally parallel relation in a single plane, each element including a plurality of first plastic monofilaments extending lengthwise and forming tubular sidewalls, and a plurality of second plastic monofilaments extending transversely of the first monofilaments and interwoven therewith, said monofilaments being constructed of a plastic selected from the list including polyethylene, saran, polypropylene and nylon and said monofilament diameters ranging from about 0.011 to 0.021 inches;

means for preventing permeation of air and moisture therethrough enclosing the pad bottom and at least certain of the pad sides;

an air permeable layer secured to the impermeable means and extending over the pad top; and means interconnecting the pad with a supply of pressurized temperature modified air.

2. Cushion apparatus as in claim 1, in which the first monofilaments have a diameter of about 0.011 inches and the second monofilaments have a diameter of about 0.021 inches.

3. Cushion apparatus as in claim 1, in which the tubular elements have a diameter of about 0.3 inches when the cushion apparatus is used as a seat or backrest.

4. Cushion apparatus as in claim 1, in which the tubular elements have a diameter of about 0.6 inches when the cushion apparatus is used as a mattress pad.

5. Cushion apparatus for being temperature conditioned by pressurized temperature modified air therein, comprising:

a unitary pad having top, bottom and sides constructed of a plurality of tubular elements arranged in side-by-side generally parallel relation in a single plane, each element including a plurality of first plastic monofilaments extending lengthwise and forming tubular sidewalls and a plurality of second plastic monofilaments extending transversely of the first monofilaments and interwoven therewith;

air and moisture impermeable means enclosing the pad bottom and at least certain of the pad sides;

an air permeable layer secured to the impermeable means and extending over the pad top;

a linear free-piston Stirling cycle heat pump having a cold end for cooling air during cooling mode, and heating means mounted on said cold end for heating air during heating mode; and a heat transferring conductor having a concavity for fitting contacting receipt with said heat pump cold end, a heat exchanger radially extending about said conductor, and a set of pin fins on said heat pump cold end surrounding said heating means.

6. Cushion apparatus as in claim 5, in which the monofilament diameters range from about 0.011 to 0.021 inches.

7. Cushion apparatus as in claim 5, in which the first monofgilaments have a predetermined diameter and the second monofilaments have a larger diameter.

8. Cushion apparatus as in claim 5, in which the tubular elements have a diameter of about 0.6 inches when the cushion apparatus is used as a mattress pad.

* * * * *